US005371853A

United States Patent [19]

Kao et al.

[11] Patent Number: 5,371,853

[45] Date of Patent: Dec. 6, 1994

[54] METHOD AND SYSTEM FOR CELP SPEECH CODING AND CODEBOOK FOR USE THEREWITH

[75] Inventors: Yuhung Kao, Lanham; John Baras, Potomac, both of Md.

[73] Assignee: University of Maryland at College Park, College Park, Md.

[21] Appl. No.: 783,127

[22] Filed: Oct. 28, 1991

[51] Int. Cl.[5] ..... G10L 9/14

[52] U.S. Cl. ..... 395/2.32; 381/36

[58] Field of Search ..... 381/36, 38, 31; 395/2.32

[56] References Cited

U.S. PATENT DOCUMENTS

| | | | |
|---|---|---|---|
| 4,797,925 | 1/1989 | Lin | 381/31 |
| 4,868,867 | 9/1989 | Davidson et al. | 381/36 |
| 4,907,276 | 3/1990 | Aldersberg | 381/36 |
| 5,187,745 | 2/1993 | Yip et al. | 381/36 |
| 5,195,137 | 3/1993 | Swaminathan | 381/32 |

*Primary Examiner*—Allen R. MacDonald
*Assistant Examiner*—Richard J. Kim

[57] ABSTRACT

Apparatus and method for encoding speech using a codebook excited linear predictive (CELP) speech processor and an algebraic codebook for use therewith. The CELP speech processor receives a digital speech input representative of human speech and performs linear predictive code analysis and perceptual weighting filtering to produce a short term speech information and a long term speech information. The CELP speech processor utilizes an organized, non-overlapping, algebraic codebook containing a predetermined number of vectors, uniformly distributed over a multi-dimensional sphere to generate a remaining speech residual. The short term speech information, long term speech information and remaining speech residual are combinable to form a quality reproduction of the digital speech input.

22 Claims, 11 Drawing Sheets

| | | | | |
|---|---|---|---|---|
| 4 1's : | 10000 | 10000 | 10000 | 10000 |
| 4 -1's : | -10000 | -10000 | -10000 | -10000 |
| 2 1's AND | | | | |
| 2 -1's : | -10000 | -10000 | 10000 | 10000 |
| | 10000 | 10000 | -10000 | -10000 |
| | -10000 | 10000 | -10000 | 10000 |
| | 10000 | -10000 | 10000 | -10000 |
| | 10000 | -10000 | -10000 | 10000 |
| | -10000 | 10000 | 10000 | -10000 |

| | r0 | r5 | r10 | r15 |
|---|---|---|---|---|
| 0. | + | + | + | + |
| 1. | + | + | − | − |
| 2. | + | − | + | − |
| 3. | + | − | − | + |
| 4. | − | + | + | − |
| 5. | − | + | − | + |
| 6. | − | − | + | + |
| 7. | − | − | − | − |

METHOD AND SYSTEM FOR CELP SPEECH CODING AND CODEBOOK FOR USE THEREWITH

FIELD OF THE INVENTION

The present invention is directed to a method and system of digitally coding and decoding of human speech. More particularly, the present invention is directed to a method and system for codebook excited linear prediction (CELP) coding of human speech and an improved codebook for use therewith.

BACKGROUND OF THE INVENTION

A major application of speech processing concerns digitally coding a speech signal for efficient, secure storage and transmission. As shown in FIG. 1, analog input speech is coded into a bit stream representation, transmitted over a channel, and then converted back into output speech. The channel may distort the bit stream, causing errors in the received bits, which may necessitate special bit protection during coding. The decoder is an approximate inverse of the encoder except that some information is lost during coding due to a conversion of an analog speech signal into a digital bit stream. Such discarded information is minimized by an appropriate choice of bit rate and coding scheme. The speech is often coded in the form of parameters that represent the signal economically, while still allowing speech recognition with minimal quality loss.

While analog transmission suffers from channel noise degradation, digital speech coding permits the complete elimination of noise both in storage and in transmission. Typical analog audio tapes corrupt speech signals with tape hiss and other distortions, whereas computer memory can store speech with only distortion arising from the necessary low pass filtering prior to analog-to-digital (A/D) conversion. To achieve this, however, sufficient bits must be used in the digital representation to reduce the quantization noise introduced in the A/D conversion below perceptible levels. Analog transmission channels always distort audio signals to a certain extent, but digital communication links can eliminate all noise effects if there are sufficient reproduction stations. Other advantages of digital speech coding include the relative ease of encrypting digital signals compared to analog signals and the ability to time multiplex multiple signals on one channel.

Recent advances in VLSI technology have permitted a wide variety of applications for speech coding, including digital voice transmissions over telephone channels. Transmission can either be on-line (real time) as in normal telephone conversations, or off-line, as in storing speech for electronic mail of voice messages or for automatic announcement devices. In either case, the transmission rate is crucial to evaluate the practicality of different coding schemes. The bandwidth of a transmission channel limits the number of signals that can be carried simultaneously. The lower the bit rate for the speech signal, the more efficient the transmission. Similarly, for electronic mail, lower bit rates reduce the computer memory needed to store the speech. Coding methods are evaluated in terms of bit rate, cost of transmission and storage, complexity (can it be implemented on an inexpensive integrated circuit chip?), speed (is it fast enough for real time applications or are there perceptible delays?), and output speech quality. For any coding scheme, quality normally degrades monotonically (but not necessarily linearly), with decreasing bit rate.

The speech research community has given names to different qualities of speech: (1) commentary or broadcast quality refers to wide bandwidth (0–7000 Hz) high quality speech with no perceptible noise; (2) toll quality describes speech as heard over the switched telephone network (200–3200 Hz range), with signal to noise ratio of more than 30 DB and less than 2–3% harmonic distortion; (3) communications quality speech which is highly intelligible but has noticeable distortion compared to toll quality; and (4) synthetic quality speech which, while greater than 80–90% intelligible, has substantial degradation, i.e., sounds machine-like and suffers from a lack of speaker identifiability. In the prior art, at least 64 kbps are required to retain commentary quality, while toll quality is found in coders ranging from 64 kbps (simple coding) to 10 kbps (complex schemes). Communications quality can be achieved at bit rates as low as 4.8 kbps, while synthetic quality is most common below 4.8 kbps. Toll quality is generally required for services to the public, while communications quality can be used in massaging systems, and synthetic quality is limited to services where bandwidth restrictions are crucial.

A wide range of possibilities exists for speech coders, the simplest being waveform coders, which analyze, code, and reconstruct speech sample by sample. Time domain waveform coders take advantage of waveform redundancies, i.e., periodicity and slowly varying intensity. Spectral domain waveform coders exploit the nonuniform distribution of speech information across frequencies. More complex systems known as source coders or vocoders ("voice coders") assume a speech production model; in particular, they usually separate speech information into that estimating vocal tract shape and that involving vocal tract excitation.

Code excited linear predicted (CELP) coding is a well known technique which synthesizes speech by utilizing encoded excitation information to excite a linear predictive coding (LPC) filter. This excitation information is found by searching through a table of candidate excitation vectors on a frame by frame basis. LPC analysis is performed on input speech to determine the LPC filter parameters. The analysis includes comparing the outputs of the LPC filter when it is excited by the various candidate vectors from the table or codebook. The best candidate is chosen based on how well its corresponding synthesized output matches the input speech frame. After the best match has been found, information specifying the best codebook entry and the filter are transmitted to a speech synthesizer. The speech synthesizer has the same codebook and accesses the appropriate entry in that codebook, using it to excite the same LPC filter to reproduce the original input speech frame.

The codebook is made up of vectors whose components are consecutive excitation samples. Each vector contains the same number of excitation samples as there are speech samples in a frame. The vectors can be constructed by two methods. In the first method, disjoint sets of samples are used to define the vectors. In the second method, using an overlapping codebook, vectors are defined by shifting a window along a linear array of excitation samples.

The excitation samples used in the vectors in the CELP codebook come from a number of possible sources. One source is the stochastically excited linear prediction (SELP) method, which uses white noise, or random numbers as samples. CELP vocoders which employ stochastic codebooks are known, as disclosed in U.S. Pat. No. 4,899,385 and shown in FIG. 2. The vocoder of the present application utilizes a new and efficient deterministic codebook.

In known CELP coding techniques, each set of excitation samples in the codebook must be used to excite the LPC filter and the excitation results must be compared utilizing an error criterion. Normally, the error criterion used determines the sum of the squared differences between the original and the synthesized speech samples resulting from the excitation information for each speech frame. These calculations involve the convolution of each excitation frame stored in the codebook with the perceptual weighting impulse response. Calculations are performed by using vector and matrix operations of the excitation frame and the perceptual weighting impulse response. In known CELP coding techniques, a large number of computations must be performed. The initial versions of CELP required approximately 500 million multiply-add operations per second for a 4.8 kbps voice encoder.

In known CELP coding techniques the search of the stochastic codebook for the best entry is computationally complex; and this is the main cause of the high computational complexity. Since the original appearance of CELP coders, the goal has been to reduce the computational complexity of the codebook search so that the number of instructions to be processed can be handled by inexpensive digital signal processing chips.

OBJECTS OF THE PRESENT INVENTION

It is an object of the present invention to accurately and efficiently digitally code human speech using a codebook excited linear predictive (CELP) speech processor.

It is another object of the present invention to optimize processing of a speech residual in the CELP speech processor by utilizing a deterministic codebook.

It is another object of the present invention to reduce substantially the computational complexity of processing the speech residual in the CELP speech processor by utilizing a deterministic codebook.

It is another object of the present invention to construct the aforementioned deterministic codebook by uniformly distributing a number of vectors over a multidimensional sphere.

This is accomplished by constructing ternary valued vectors (that is where each component has the value $-1$, 0 or $+1$), having 80% of their components with value zero, and fixed non-zero positions. The fixed position of the non-zero elements is uniquely identifiable with the present invention in comparison with the other schemes.

SUMMARY OF THE INVENTION

The above-mentioned objects of the present invention are accomplished by virtue of the novel codebook excited linear prediction (CELP) speech processor and codebook for use therewith. The CELP speech processor of the present application receives a digital speech input (refer to FIG. 3) and performs linear predictive code (LPC) analysis and perceptual weighting filtering on the digital speech input to produce a short term speech residual and LPC filter information (short term speech information). Subsequently the CELP speech processor of the present application performs pitch analysis on the short term speech residual to produce a long term speech residual and pitch information (long term speech information). The CELP speech processor of the present application utilizes subsequently a deterministic, non-overlapping codebook with a predetermined number of vectors which are uniformly distributed over a multi-dimensional sphere, to determine the codebook index and gain which best matches the long term speech residual. The deterministic, non-overlapping, codebook includes a predetermined number of vectors partitioned into a second predetermined number of subvectors. A substantial number of the elements of each of these subvectors have value equal to zero, and the remaining number of elements in each of these subvectors have value equal to 1 or $-1$.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENT

Figure 1:
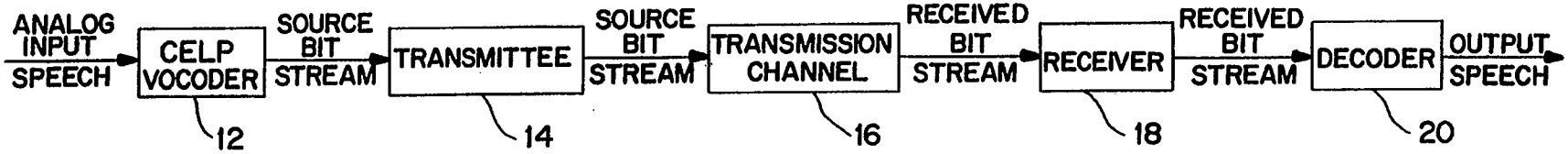
FIG. 1 is a block diagram of a typical digital speech transmission system.
Figure 2:
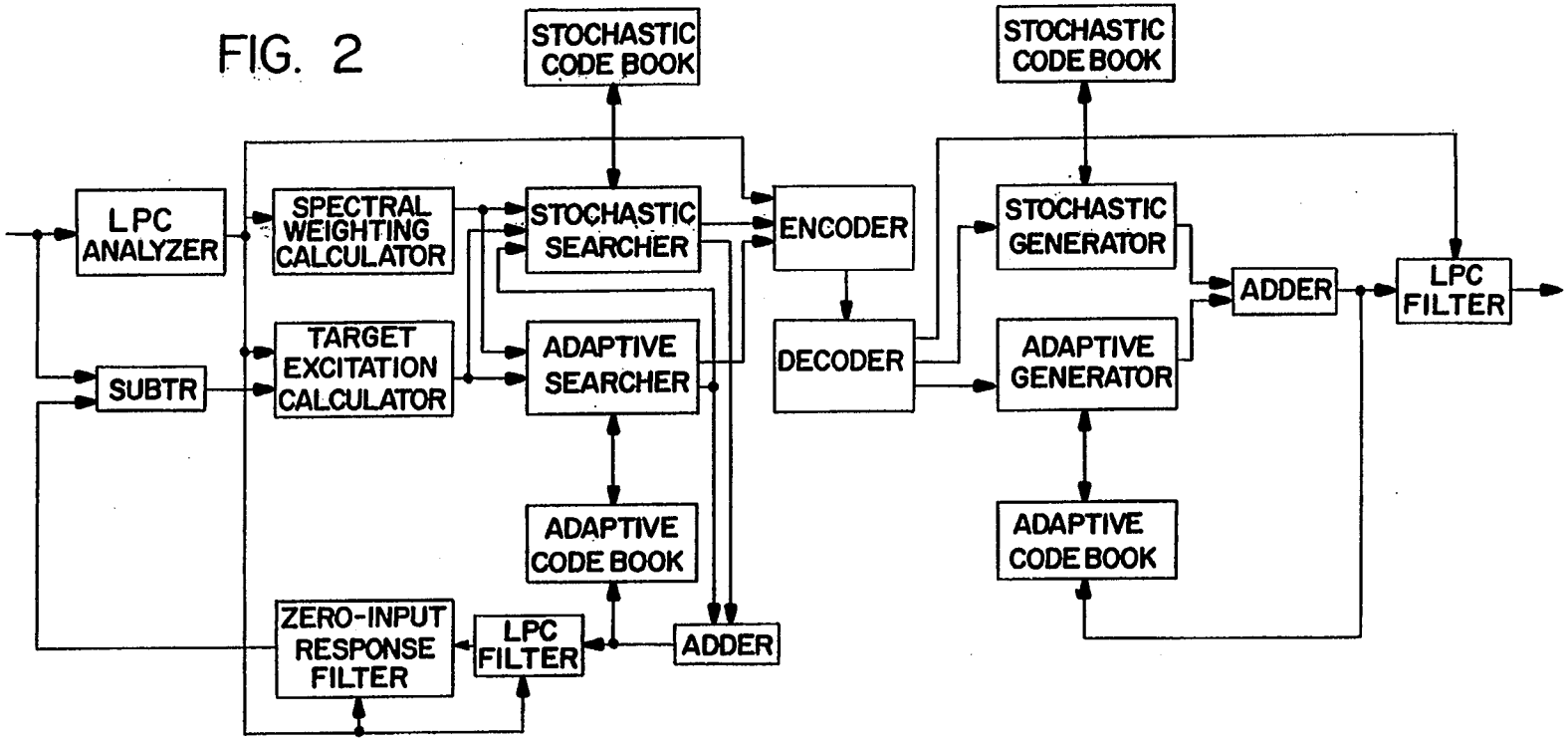
FIG. 2 is a diagram of one type of prior art CELP vocoder.

An understanding of the present invention may be more easily had by reference to the attached drawings which describe a preferred embodiment of the present invention. A digital transmission system 10 of FIG. 1, receives analog input speech via a CELP vocoder 12 and generates a source bit stream which is sent to a transmitter 14 which transmits the source bit stream across transmission channel 16 which is received at the destination by a receiver 18. The received bit stream is decoded by looking up in the codebook of decoder 20, the identical entry which was coded by CELP vocoder 12 to reproduce the original input speech as output.

Figure 3:
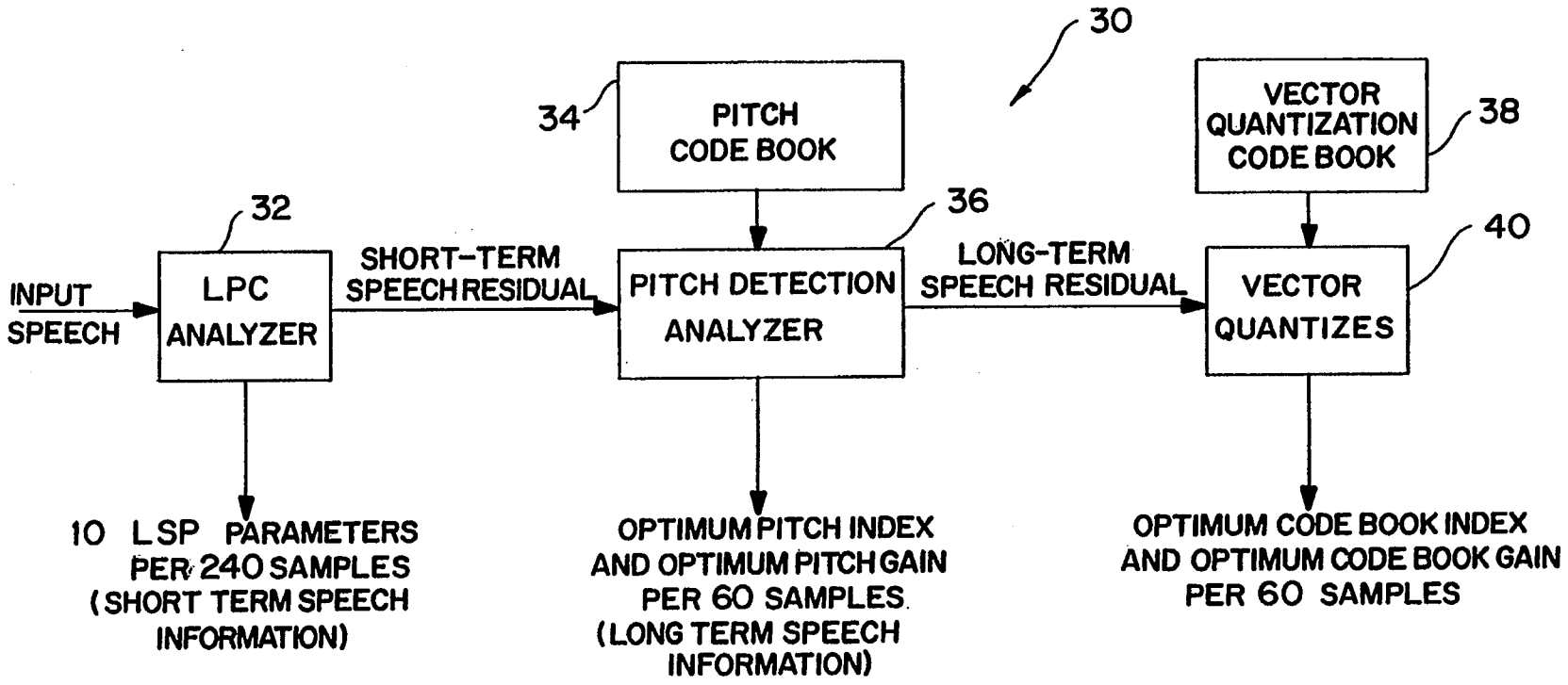
FIG. 3 is a diagram illustrating the multistage extraction of information from the input speech frame signal in one embodiment of a CELP coding system of the present invention.

The CELP vocoder 12 of FIG. 3, partitions the input speech into three separate residuals, a short term speech residual, a long term speech residual, and a remaining speech residual. The CELP vocoder 30 receives the input speech and performs linear predictive code analysis using an LPC analyzer 32 to generate 10 line spectrum pair parameters (short term speech information) for every 240 samples of input speech, in order to extract the short term speech residual. A pitch detection analyzer 36 receives the short term speech residual and generates an optimum pitch codebook index and optimum pitch gain for every 60 samples of input speech (long term speech information) and a long term speech residual. The pitch detection analyzer 36 uses the pitch codebook 34 to generate the optimum pitch codebook index, by selecting the entry in the pitch codebook 34 which most closely resembles the short term speech residual. A vector quantizer 40 receives the long term speech residual and generates an optimum residual codebook index and optimum residual gain for every 60 samples of input speech. The vector quantizer 40 utilizes a vector quantization codebook 38, which is organized according to the present application, to obtain a codebook index, which represents the vector in the vector quantization codebook 38, which most closely resembles the long term speech residual.

Figure 4:
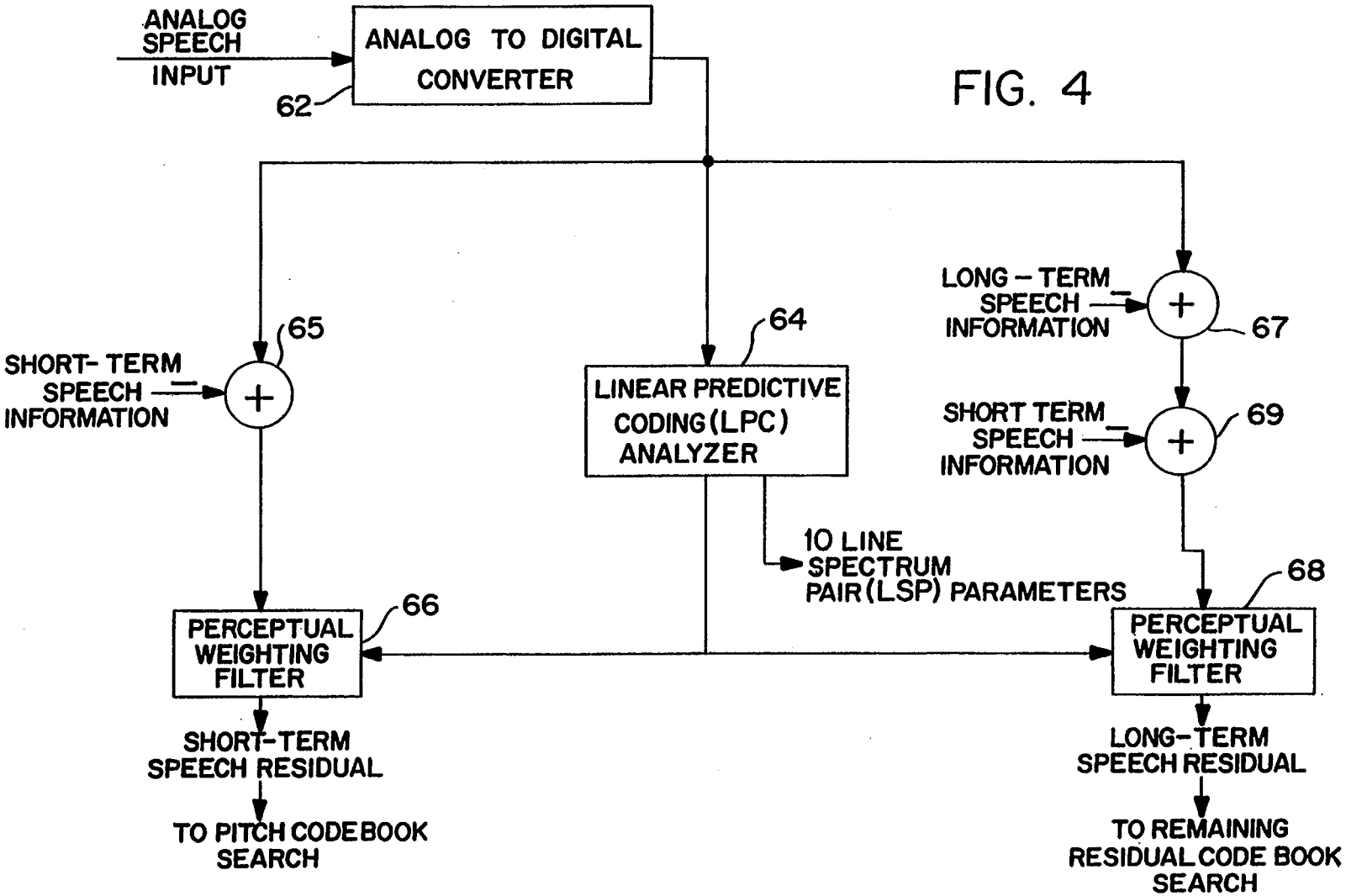
FIG. 4 is a diagram illustrating the analysis portion of a CELP coding system of the present invention.
Figure 5:
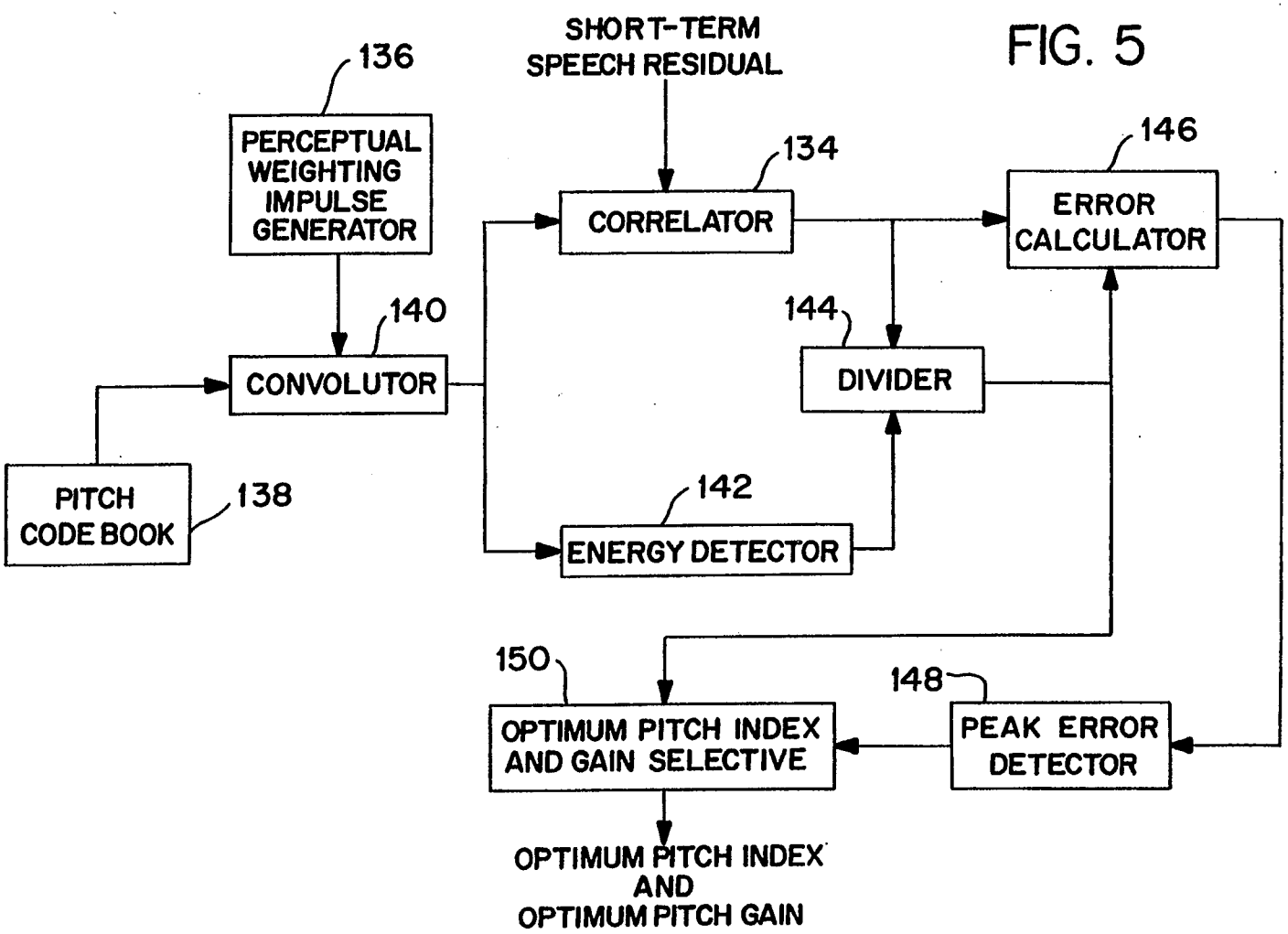
FIG. 5 is a diagram illustrating a pitch codebook searching portion in a CELP coding system of the present invention.

A CELP vocoder performs two functions, analysis and synthesis. The LPC analysis portion of a CELP coding system is illustrated in greater detail in FIG. 4. An analog speech input is received by an analog-to-digital converter 62 which transmits a digital speech input to LPC analyzer 64. The LPC analyzer 64 performs linear predictive code analysis and generates line spectrum pair parameters which are transmitted to perceptual weighting filter 66 and perceptual weighting filter 68. Subtractors 65, 67, and 69 subtract the short term speech or long term speech information from a previous frame of samples, as shown in FIG. 4, prior to performing perceptual weighting filtering. The perceptual weighting filter 66 performs perceptual weighting to generate the short term speech residual. The perceptual weighting filter 68 performs perceptual weighting to generate the long term speech residual. Both the short term speech residual and the long term speech residual are fed to other elements of the CELP coding system (as will be hereinafter described) so that codebook searches may be performed. FIG. 5 illustrates the pitch codebook search for the short term speech residual portion of a CELP coding system in greater detail. The short term speech residual is received and correlated using a correlator 134. The output of a perceptual weighting impulse response generator 136 is convolved with a selected entry from a pitch codebook 138 by a convolutor 140. The output of the convolutor 140 is provided to the correlator 134 and an energy detector 132. The output of the correlator 134 is divided by an output of the energy detector 142 in a divider 144. The output of the divider 144 and the output of the correlator 134 are supplied to an error calculator 146 which generates an error term which is supplied to a peak error detector 148. The output of the peak error detector 148 is supplied to an optimum pitch index and gain selector 150, as is the output of the divider 144 to select the optimum pitch index in pitch codebook 138 which most closely represents the short term speech residual.

Figure 6:
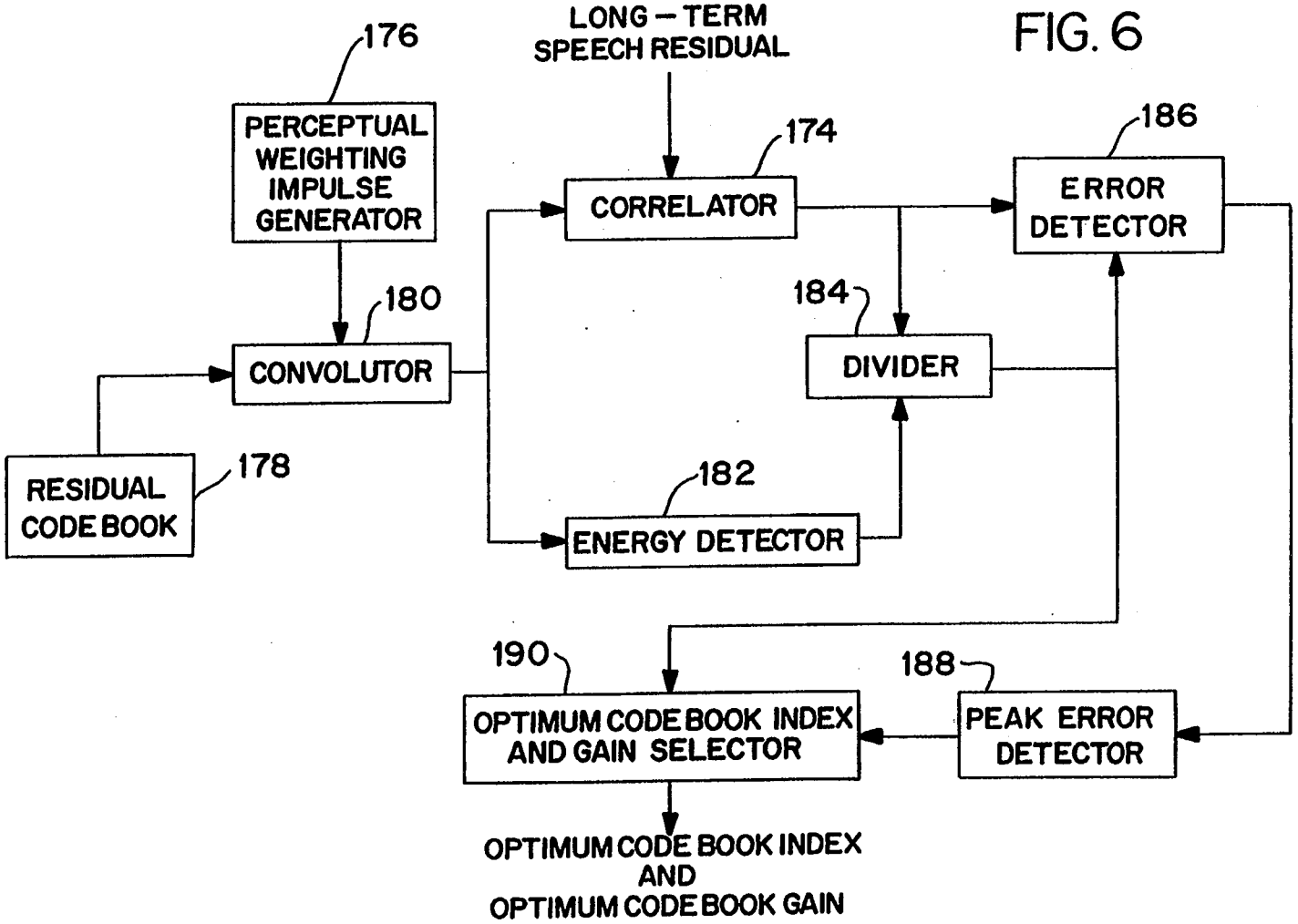
FIG. 6 is a diagram illustrating the speech residual codebook searching portion in a CELP coding system of the present invention.

FIG. 6 illustrates a principle portion of the CELP coding system of the present invention, that is a portion of the system which performs a residual codebook search for the remaining speech residual. The long term speech residual is provided to a correlator 174 and is correlated thereby. The output of a perceptual weighting impulse response generator 176 is convolved with a selected entry from a residual codebook 178 by a convolutor 180. The output of the convolutor 180 is provided to the correlator 174 and an energy detector 182. The output of the correlator 174 is divided by an output of the energy detector 182 in a divider 184. The output of the divider 184 and the output of the correlator 174 are supplied to an error calculator 186 which generates an error term which is supplied to a peak error detector 188. The output of the peak error detector 188 is supplied to an optimum codebook index and gain selector 190, as is the output of the divider 184 to select the optimum codebook index in the residual codebook 178 which most closely resembles the long term speech residual.

Figure 7:
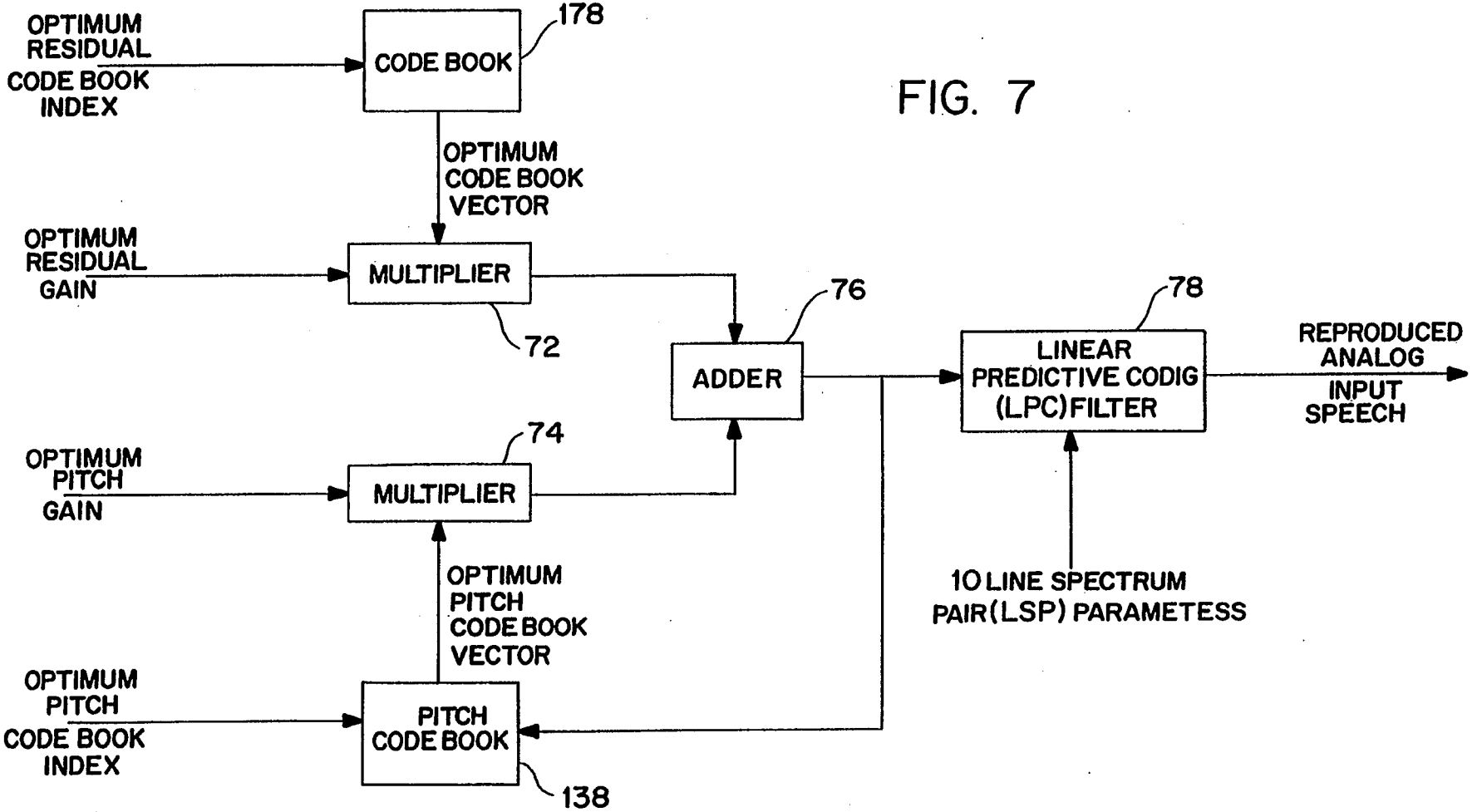
FIG. 7 is a diagram illustrating the synthesis portion of a CELP coding system of the present invention.

CELP synthesis as shown in FIG. 7 illustrates a CELP synthesis portion or decoder 20 which utilizes the optimum pitch index and gain from the pitch codebook search and the optimum codebook index and gain from the codebook search to reproduce the original analog speech input. The codebook vector, produced by the codebook 178 and associated with the optimum codebook index and optimum codebook gain selected by the optimum codebook index and gain selector 190 in the codebook search are multiplied by a multiplier 72, as shown in FIG. 7. The pitch codebook vector, produced by a pitch codebook 138 and associated with the optimum pitch index, and optimum gain selected by optimum pitch index and gain selector 150 of FIG. 5 from the pitch codebook search are multiplied by a multiplier 74. The output of the multiplier 72 and the multiplier 74 are added by an adder 76 and the sum is transmitted to an LPC filter 78 which utilizes the line spectrum pairs generated by the linear predictive code analyzer 64 of FIG. 4 to reproduce the original analog input speech. Adder 76 is also utilized to update the pitch codebook.

Low bit, high quality speech coding is a vital part of voice telecommunication systems. The introduction of CELP speech coding in 1982 provided a feasible way to compress speech data to 4.8 kbps with high quality. However, the formidable computational complexity required for real time processing has prevented its wide application. Using the codebook of the present application, the computational complexity has been reduced to 5 million instructions per second (MIPS), which can be handled by even inexpensive digital signal processing (DSP) chips, while maintaining high quality speech reproduction.

It is known in the art that speech residuals (what is left after short and long term predictions are removed) are Gaussian distributed, therefore, stochastic codebooks have been used (generated by a Gaussian process) to predict the speech residual. But since stochastic codebooks are generated randomly, there are no special structures to organize and search them, therefore an exhaustive search is necessary to find an optimum codebook vector. Overlapping codebooks have been proposed but their computational complexity is still very high. Furthermore, the use of overlapped codebooks is an approximation and degrades speech quality. The present application constructs a deterministic codebook and by its regular structure generates efficient ways to search the codebook.

First, the physical meaning of finding an optimum excitation vector in the codebook must be explained. In CELP, after short and long term predictions, what remains is a residual speech vector r, which must be matched with a codebook vector $\bar{x}$, which after scaling, will produce minimum square error from the speech residual vector $\bar{r}$. Because of the scaling factor, the criterion is not the same as nearest neighbor in the Euclidean distance sense. To illustrate, for a residual speech vector $\bar{r}$ and a codebook vector $\bar{x}$, the criterion is equivalent to maximizing:

$$\frac{|r'x|^2}{|x|^2} = \frac{|r|^2\,|x|^2\cos^2\theta}{|x|^2} = |r|^2\cos^2\theta$$

over $\bar{x}$ in the codebook.

Figures 8, 9:
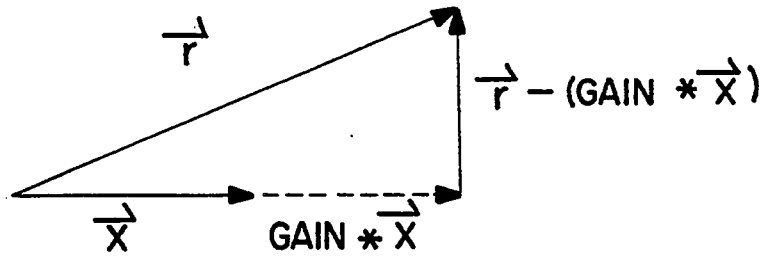
FIG. 8 is a geometric representation of the search for the optimal codeword vector $\bar{x}$ which is most parallel to the speech residual $\bar{r}$.
FIG. 9 depicts the eight combinations for each subvector of 20 elements.

Because $\bar{r}$ is fixed in the search, we must maximize $\cos^2\Theta$. Maximizing $\cos^2\Theta$ is equivalent to minimizing $\sin^2\Theta$, thus minimizing the difference between the vector r and the vector G*x (where G is the gain). Maximizing $\cos^2\Theta$ means finding a residual codebook vector which is most parallel to the remaining speech residual as shown in FIG. 8.

From the above discussion, we know that the criterion for a good codebook is that it must span a multi-dimensional sphere as uniformly as possible. For a fixed number of vectors, the codebook will have the best directional representation ability if its vectors are uniformly distributed over the multi-dimensional sphere. Based on this observation we have constructed a codebook which can span the multi-dimensional sphere more uniformly than a randomly generated stochastic codebook. This means that a codebook can be constructed which is actually better than a stochastic codebook. We call this type of codebook a deterministic codebook. Other such codebooks have been proposed for CELP coding, however, the codebook of the present application is substantially different. The main reason justifying the use of randomly generated stochastic codebooks is that, as explained above, the distribution of the speech residuals is approximately Gaussian. Therefore, an independent identically distributed Gaussian process has been used to generate the codebook. The deterministic codebook of the present application takes this Gaussian property into consideration in order to reduce the codebook to a manageable size as will be discussed below.

The elements of the codebook vectors which make up the codebook of the present application are ternary valued, i.e., the possible values are −1, 0, and 1. Since the direction of a codebook vector is used as the matching criterion, rather than its exact location, this ternary restriction enables directional representation of each vector to be retained.

The NSA CELP standard (which has now become Federal Standard 1016) sets the sub-frame size at 60 elements. This means that even with the ternary restriction, there are $3^{60}-1$ possible vectors in the 60 dimensional space. In order to achieve 4.8 kbps encoding rate, there can only be 9 bits for the codebook index, meaning that the codebook size can only be $2^9$. We therefore need to drastically reduce the codebook size. This is accomplished by utilizing the Gaussian distribution properties of speech residuals. Since most of the residuals are fairly small, a large amount of the codebook vector elements are set to zero in order to reduce the size of the codebook. The NSA reports fairly good performance using a 77% zero codebook. Rounding this to 80% (so that the multiplication of the percentage by 60 results in an integer) implies that there are 48 zeros out of the 60 components, and the remaining 12 components take the value +1 or −1. After these simplifications, the number of possible vectors is:

$$S_w^n = 2^w \times \binom{n}{w} = \frac{2^w \times n!}{(n-w)! \times w!} = \frac{2^{12} \times 60!}{48! \times 12!}$$

where n is the dimension, and w is the weight (where the weight is the number of non-zero elements in the 60 element vector). This is still much larger than the desired $2^9$.

Since speech residuals are time sequences and human ears are insensitive to phase shifts in speech waveforms, the positions of the 12 1's and −1's are not that important. If 12 fixed positions are chosen, the size of the codebook is reduced to $2^{12}$. The codebook of the present application places the 12 1's and −1's uniformly over the 60 positions, i.e., only elements with an index of 5n (where $0 \leqq n \leqq 11$) are non-zero, i.e.,

XOOOOXOOOOXOOOO . . .

where each X can be either 1 or −1. Now we have a 60-dimensional vector which has 12 uniformly distributed "spikes" as shown below.

↑. . . . ↓. . . . ↑. . . . ↓. . .

However, several critical reductions must be imposed in order to reduce the size of the codebook from $2^{12}$ to $2^9$, as required by the Federal Standard 1016. This represents a compromise which nevertheless does not result in noticeable degradation of speech quality. Applicant has invented a novel CELP speech processor and codebook for use therein which substantially reduces the processing complexity necessary to perform 4.8 Kbps speech encoding by efficiently designing the residual codebook. First, according to the novel, optimized codebook of the present application, each 60 element vector is partitioned into 3 equal length subvectors. The length of each subvector is 20 and there are 4 non-zero elements in each. A further restriction imposed on the codebook, which further improves the operation of the CELP speech processor of the present application, allows only an even number of non-zero elements in each subvector. This results in the following possible combinations of non zero elements for each subvector: 4 1's (1 combination), 4 −1's (1 combination), or 2 1's and 2 −1's (six combinations depending on the placement of the 1's and −1's). The eight possible combinations for each subvector of 20 elements is shown in FIG. 9. Since each subvector has 8 combinations that means that each vector has $8^3$ combinations, which equals $2^9$ combinations. Thus, a codebook of size $2^9$ is defined, which requires 9 bits for the encoding of codebook index, which is sufficiently small to achieve the goal of 4.8 kbps encoding. The novel CELP speech processor of the present application makes the implementation of a realtime 4.8 kpbs coding scheme possible on a single digital signal processing chip due to the resulting substantial reduction of computational complexity. It is also important to note that because this is a deterministic codebook, it is unnecessary to store the codebook itself; the codebook index alone specifies each vector exactly. It is also important to note that a variety of similar deterministic codebooks can be designed, by those skilled in the art, using the key methodology described in this invention by modifying the actual position of the non-zero elements of the vectors, as well as the size of the vectors. This allows the development of high quality CELP processors at rates of 2.4 kbps to 16 kbps.

The primary attraction of CELP speech coding is that it provides high quality speech coding (almost equivalent to toll quality) at a low data rate, (for example at 4.8 kbps). CELP is suitable for digital radio applications, encrypted telephone communications, and other applications wherein voice must be digitized prior to encryption. CELP is also required in order to provide privacy for cellular communication techniques.

CELP is an analysis by synthesis technique. Speech information is extracted in three steps as shown in FIG. 5:

a. short term (envelope) speech information is extracted as line spectrum pair parameters,
b. long term (pitch) speech information is extracted as the pitch index and gain, and
c. a remaining speech residual (an approximation of the "innovation process") is represented by Gaussian vectors of independent components.

Speech coders can be classified into two main categories: wave form coders and vocoders. Wave form coders encode the digital high speed signal "sample by sample" such that they are of good quality but have very high data rates. However, if one looks at a speech waveform, there are many redundancies in the signal. Therefore it is not necessary to encode speech "sample by sample". Instead, a block of samples can be encoded by extracting features from the signal, which is precisely the idea of the vocoder 30, shown in FIG. 3. Vocoders are "source dependent" i.e., the CELP vocoder is for speech only, and not for music, thus it is tailored for the special features of speech generation, which are not valid for music.

The mechanism for generating new speech signals can be classified into two categories:

1. voiced sound—a vocal cord generates a vibration, which is subsequently modulated by the vocal tract, and
2. unvoiced sound—there is no vocal cord vibration. There is only an air flow which is subsequently modulated by the vocal tract.

Therefore, two kinds of information are involved in speech, vocal cord vibration, which can be treated as FM information and vocal tract modulation, which shapes the envelope of the speech symbol, which can be treated as AM information. A real speech waveform is approximated by the sum of the FM and AM information.

The purpose of the CELP vocoder 30 is to extract these two types of information from the speech signal efficiently. As shown in FIG. 3, LPC analyzer 32 simulates the vocal tract and captures AM information. Pitch detection analyzer 36 models the vocal cord vibration, which captures FM information. However, if only the AM and the FM information are extracted, the reconstructed speech sounds rough. In the device of the present application, vector quantizer (VQ) 40 is provided to process the "remaining speech residual" in order to make the reconstructed speech sound more natural. The quality of the reconstructed speech depends on the size of the VQ codebook 38 (the larger the better). The critical problem here is that the required codebook search is very computationally expensive. As an example, for a random codebook of size 512, CELP requires 100 MIPS for real time processing. If an overlapped codebook is used, CELP still requires 20 MIPS. The problem of reducing this computational complexity has existed since the introduction of CELP. This reduction in computational complexity is achieved by the processor of the present application. Since an extensive search of a stochastic codebook using the CELP algorithm requires about 20 MIPS (for a overlapping codebook of size 512 to run in real time) a goal of the present application is to replace the time consuming linear search with some efficient heuristics. Together with other algorithmic approximations and heuristics, the objective of the present application is to show that the computational complexity can be reduced to under 10 MIPS, which can be processed by a single Texas Instruments TMS320C30 chip, or equivalent.

FIG. 4 illustrates the analysis part of CELP speech coding, while FIG. 7 illustrates the synthesis part of CELP speech coding. The analysis part determines the 10 line spectrum pair (LSP) parameters, the optimum pitch index and optimum pitch gain, and the optimum codebook index and optimum codebook gain that must be transmitted to a decoder. Traditional CELP synthesis uses a Gaussian codebook vector and a gain to scale it, and a pitch codebook vector and a gain to scale it, to produce a combined "additive excitation" for the LPC filter whose coefficients are updated on-line. The difficult part of CELP is the analysis, due to its high computational complexity. CELP analysis consists of three steps:

1. LPC analysis,
2. pitch prediction, and
3. remaining speech residual vector quantization.

These topics will be addressed in turn.

The first step of CELP analysis is short term prediction, i.e., extract envelope (spectrum) information. The output of the LPC analyzer 32 is an all-zero predictor filter or a corresponding all-pole synthesis filter. The parameters of this filter can be transmitted directly (as LPC coefficients) or the equivalent lattice form reflection coefficients (PARCOR) can be used to represent the filter. Line spectrum pairs (LSP) can be used to encode the speech spectrum more efficiently than other parameters due to the relationship between the line spectrum pairs and the formant frequencies. LSP can be quantized taking into account spectrum features known to be important in perceiving speech signals. In addition, line spectrum pairs are suitable for frame to frame interpolation with smooth spectral changes because of their frequency domain interpretation.

There are three types of parameters, LPC, PARCOR, and LSP, all of which can be derived by LPC analysis and are mathematically equivalent if double precision numbers are used to represent the parameters. Since the purpose here is to quantize the parameters to reduce the data rate, the parameters which result in the smallest quantization error, and therefore cause the least distortion in resulting speech quality, should be used. The parameters which minimize quantization error in a preferred embodiment of the present application are the line spectrum pairs (LSP).

In order to efficiently compute the line spectrum pairs, an iterative root finding algorithm must be applied to Chebyshev polynomials. The basic LPC/10 prediction error filter is as follows:

$$A(z) = 1 - \sum_{k=1}^{10} a(k)z^{-k}$$

The A(k) are the direct form predictor coefficients, i.e., LPC coefficients, and the corresponding all-pole synthesis filter has a transfer function of $$\frac{1}{A(z)}.$$

Figure 10:
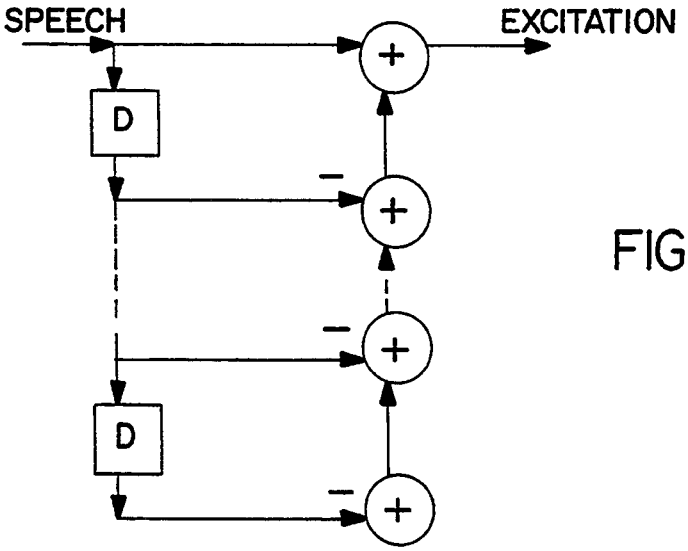
FIG. 10 is a diagram of a direct form LPC filter used for analysis in the CELP coding system of the present invention.
Figure 11:
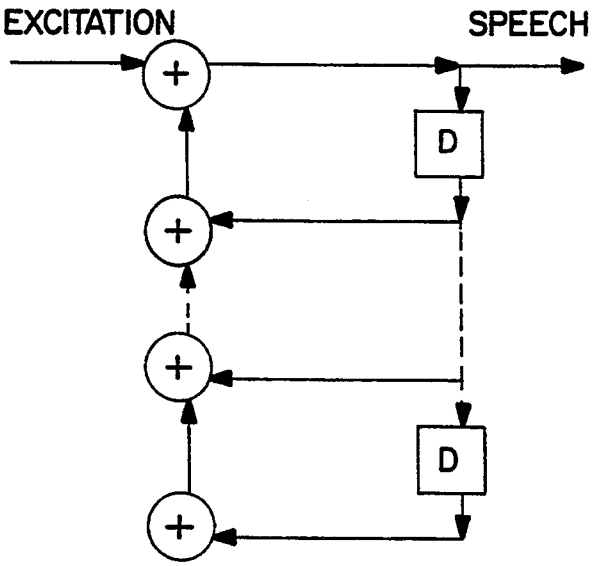
FIG. 11 is a diagram of a direct form LPC filter used for synthesis in the CELP coding system of the present invention.

The analysis and synthesis filters are shown schematically in FIGS. 10 and 11, respectively where the blocks labelled "D" represent time delays. A symmetric polynomial $F_1(z)$ and an anti-symmetric polynomial $F_2(z)$, related to A(z), are formed by adding and subtracting the time reverse system function as follows:

$$F_1(z)=A(z)+z^{-11}A(z^{-1})$$

$$F_2(z)=A(z)-z^{-11}A(z^{-1})$$

The roots of these two polynomials determine the line spectrum pairs. The two polynomials $F_1(x)$ and $F_2(x)$ are equivalent to the system polynomials for an 11 coefficient predictor derived from a lattice structure. The first 10 stages of the lattice have the same response of the original 10 stage predictor. An additional stage is added with a reflection coefficient equal to +1 or −1 to give the response of $F_1(z)$ or $F_2(z)$, respectively. The vocal tract characteristics can be expressed by 1/A(z), and the vocal tract is modeled as a non-uniform section acoustic tube consisting of 10 sections. The acoustic tube is open at the terminal corresponding to the lips, and each section is numbered beginning from the lips. Mismatch between the adjacent sections n and n+1 causes wave propagation reflection. The reflection coefficients are equal to the PARCOR parameters. The eleventh stage, which corresponds to the glottis, is terminated by mismatched impedance. The excitation signal applied to the glottis drives the acoustic tube.

Figure 12:
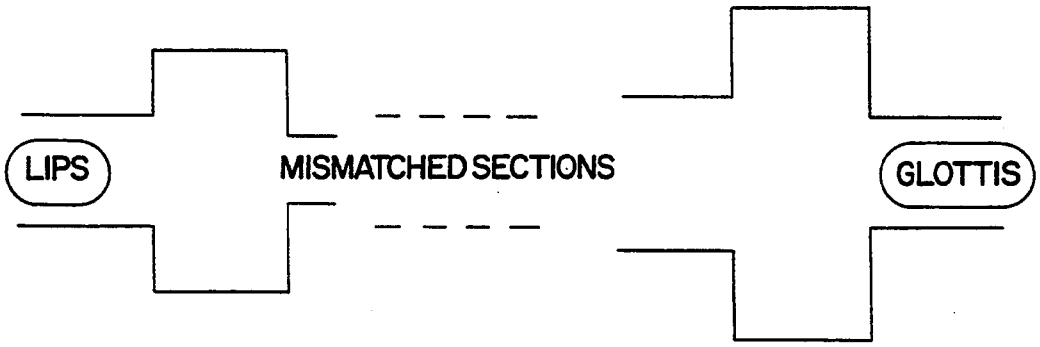
FIG. 12 is a simplified graphical representation of the human vocal tract.
Figure 13:
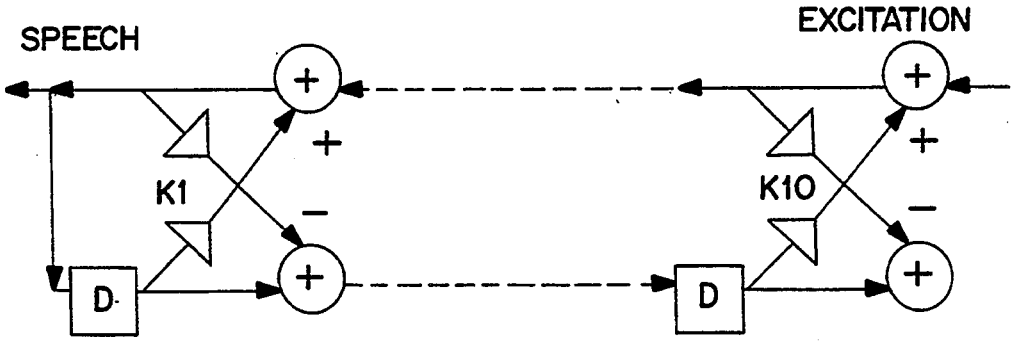
FIG. 13 is a diagram of a lattice filter for CELP analysis in the CELP coding system of the present invention.
Figure 14:
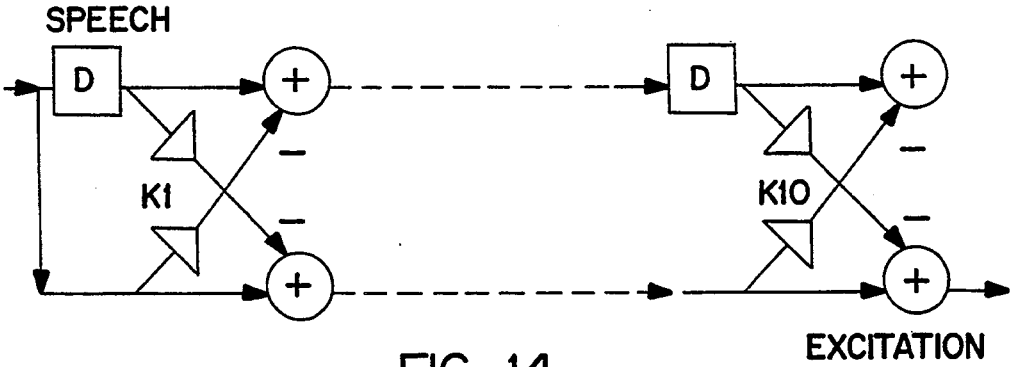
FIG. 14 is a diagram of a lattice filter for CELP analysis in the CELP coding system of the present invention.

As is known to a person of ordinary skill in this art, the PARCOR lattice filter is regarded as a digital filter equivalent to the acoustic model shown in FIGS. 12, 13, and 14.

The second step in CELP analysis is to extract pitch information, which is also called long term prediction. It is simply the use of one of the previous frames (20 to 147 delays) to represent the current frame. The search scheme is illustrated in FIG. 5.

Because the pitch codebook 34 of FIG. 5 is overlapped, each vector group of 60 samples is just a shift to the previous vector, and contains only one new element. Thus, the end point correction technique can be used to reduce the operations necessary to compute the perceptual weighted vectors.

If the first codebook vector is {v(0), v(1), v(2) . . . v(59)}, the perceptual weighting impulse response is {h0), h(1), h(2) . . . h(9)}, and the vector after perceptual weighting is $\{y_0(0), y_0(1), y_0(2) \ldots y_0(59)\}$, then the next codebook vector $y_1$ will be given by:

$$y_1(0)=h(0)*v(0)$$

$$y_1(1)=y_0(0)+h(1)*v(0)$$

$$\ldots$$

$$y_1(9)=y_0(8)+h(9)*v(0)$$

$$y_1(10)=y_0(9)$$

$$\ldots$$

$$y_1(59)=y_0(58)$$

Figure 15:
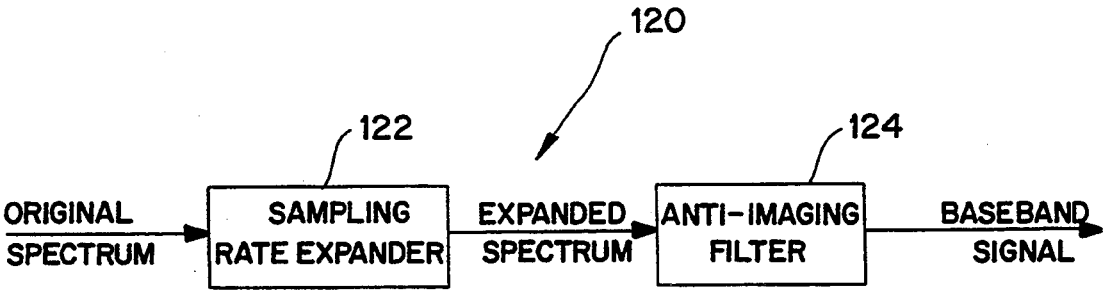
FIG. 15 is a diagram of an interpolation system for pitch prediction in the CELP coding system of the present invention.
Figure 16A:
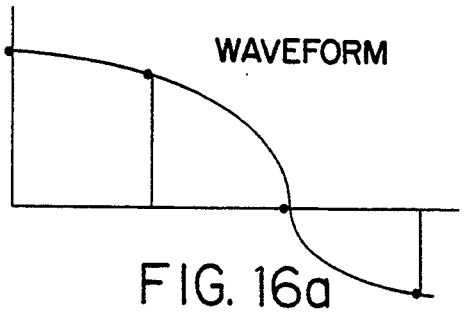
FIGS. 16*a*, 16*b*, 16*c*, 16*d*, 16*e*, and 16*f* are diagrams of the waveform and spectra of interpolated signals generated from the system of FIG. 15.
Figure 16B:
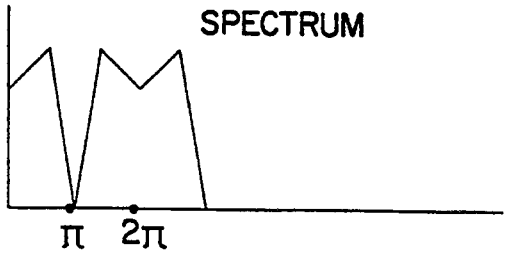
Figure 16C:
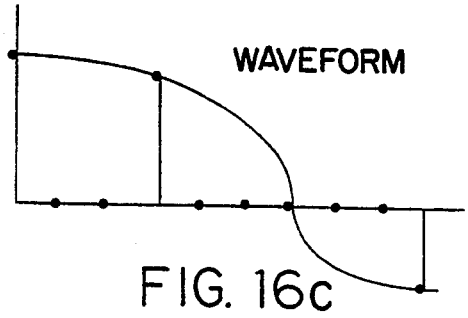
Figure 16D:
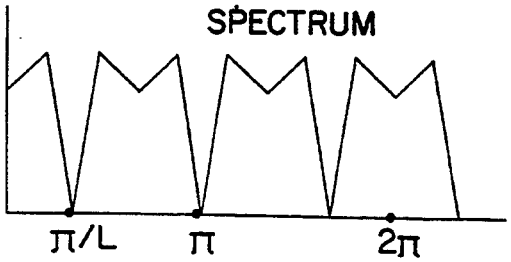
Figure 16E:
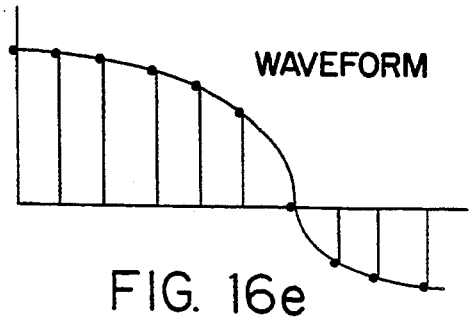
Figure 16F:
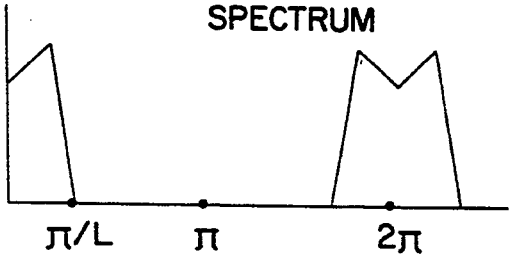

The computational complexity of the pitch search can be attributed to three major parts, shown in FIG. 5: convolution performed by convolutor 140, correlation performed by correlator 134, and energy detection performed by energy detector 142. These operations must be done for each group of 60 samples. It is known that pitch resolution is very important, especially for high pitched speakers. However, the resolution of pitch prediction is bounded by the sampling rate. In order not to increase the original speech data sampling rate, we need to interpolate speech samples, which means increasing the sampling rate "internally". An interpolator 120, for "increasing" the sampling rate of the short term speech residual is shown in FIG. 15.

If the sampling rate is to be increased by a factor of L, L-1 new samples between each pair of original samples must be generated by a sampling rate expander 122. This process is similar to digital-to-analog conversion. Interpolating results in the spectrum containing not only the baseband frequencies of interest, but also images of the baseband centered at harmonics of the original sampling frequency. To recover the baseband signal and eliminate the unwanted image components, it is necessary to filter the interpolated signal with an anti-imaging filter 124. Typical waveforms and spectra for interpolation by an integer factor L are shown in FIGS. 16*a*, 16*b*, 16*c*, 16*d*, 16*e*, and 16*f*.

Experimental evidence also indicates that including fractional delays, in addition to integer delays, can reduce the rough sounding quality of high-pitched speakers. Fractional delays also reduce noise because increased pitch prediction resolution reduces the noisy speech residual and therefore improves the similarity between the speech residual and codebook excitation vector. In the device of the present application, 128 integer delays (20 to 147 equating to 54.4 Hz to 400 Hz) and 128 non-uniformly spaced fractional delays are stored in the pitch codebook 34, which are designed to gain the greatest improvement in speech quality by providing high resolution for a typical female speaker and low resolution for male and child speakers.

Figure 17A:
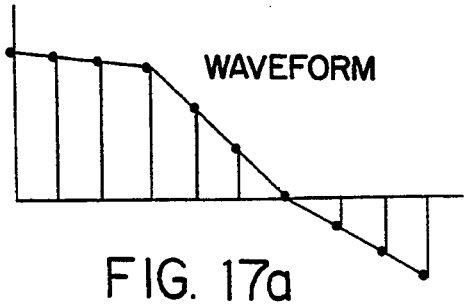
FIGS. 17*a* and 17*b* are graphical representations of the ripple effect which is minimized using an interpolation system such as the one illustrated in FIG. 15.
Figure 17B:
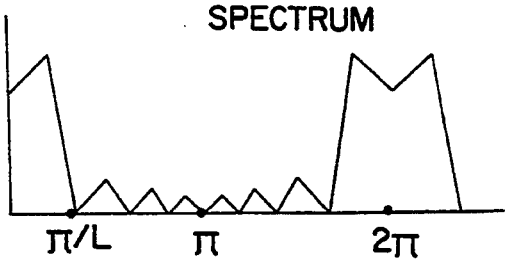

Simple linear interpolation may also be used instead of sinc impulse response as described above. Linear interpolation is equivalent to triangle impulse response, its spectrum is $\text{sinc}^2$, which means there are ripples outside the baseband, i.e., the images are not eliminated completely. Even if a windowed sinc function is used, the images are not eliminated completely. In order to eliminate the images completely, an infinite since impulse response must be used, which is impossible. A window must be used to make the impulse response finite and to reduce the ripples outside the baseband as shown in FIGS. 17*a*, and 17*b*.

Sinc values can be pre-computed by the following equation:

$$x(t) = \sum_{h=-\infty}^{\infty} x(n) \frac{\sin[\Pi(t - nT)/T]}{\Pi(t - nT)/T} = \sum_{n=\infty}^{\infty} x(n)\text{sinc}[(t - nT)/T].$$

When three-fold interpolation is employed, x(t) need only be evaluated at t=0, T/3, 2T/3 and T. Sinc(1/3), sinc(2/3), sinc(1), and sinc(4/3) must be calculated and weighted and stored in a table, so they may be looked up at a later time.

The processor of the present application does not search all 128 integer and 128 fractional delays at once, instead a two stage search is used. First, integer delays are searched and the best integer delay is selected. Then this integer delay is fine tuned by searching its neighboring fractional delays (6 neighbors).

Pitch index typically does not change rapidly; especially in a steady vowel sound, pitch index will stay around a particular value for several sub-frames (equivalent to 60 samples). Therefore, it is not necessary to search through the whole range of delays for every subframe. There are 4 sub-frames in each frame numbered 0, 1, 2, and 3. For sub-frame 0, the whole delay range is searched and the best delay is found, for subframe 1, only the neighboring 64 delays are searched. Sub-frames 2 and 3 are searched similarly to sub-frame 1. This delta coding scheme, saves encoding bits and reduces the computation by about 1.5 MIPS.

Perceptual weighting filters 66 and 68 perform perceptual weighting which is essential in CELP coding. It is used in pitch search and codebook search for frequency domain weighting. The goal is to weigh the noise according to the speech spectrum to get the best perceptual results. The transfer function of the perceptual weighting filter is as follows:

$$W(z) = \frac{A(z)}{A(z/\alpha)} = \frac{1 - \sum_{k=1}^{10} a(k)z^{-k}}{1 - \sum_{k=1}^{10} a(k)\alpha^k z^{-k}}$$

Where $0<\alpha<1$, and A(z) is the predictor error polynomial.

For $\alpha=1$, W(z) is an all-pass filter, that is there is no weighting. For $\alpha=0$, W(z) is the inverse of the spectrum, which means the noise is weighted more at a spectrum valley and less at a spectrum peak. For any value between 0 and 1, the weighting filter is between these two numbers. As a result of conducting a series of listening tests, the device of the present application uses $\alpha=0.8$.

After short and long term predictions, the spectrum (envelope) information and pitch information have been extracted, and what is left is a remaining speech residual which is a noise-like sequence. This residual, although it retains little information, is necessary in order to provide quality speech reproduction. The key idea in CELP coding is to use a noise-like codebook to encode this residual. In a preferred embodiment, the processor of the present application utilizes a 512-size codebook 178, as shown in FIG. 6. Of course, the larger the codebook size, the better the speech results. The speech residual is an approximation of the so called "innovation sequence" associated with the sampled speech data. If y(n) represents the speech samples and F(y, n−1) represents the information contained in the past samples, before n, the innovation sequence is defined by $w(n)=y(n)-E\{y(n)|\ F(y,n-1)\}$. The extraction of short and long term predictions approximates the term $E\{y(n)|F(y, n-1)\}$. Because the extraction of the short and long term predictions are an approximation and because real speech signals are not Gaussian, it is justified to retain the remaining speech residual. In theory, w(n) is a white-noise, Gaussian sequence.

Most of the CELP computational complexity is attributed to codebook search for the remaining speech residual. In FIG. 6, the computation can again be attributed to 3 major operations: convolution performed by convolutor 180, correlation performed by correlator 174 (inner product calculation), and energy detection performed by energy detector 182. If one assumes that the length of the perceptual weighting impulse is 10, an estimate of the cost of computation for the convolution operation would be 537,600 operations, for the correlation calculation, 60,930 operations and for the energy calculation 60,930 operations. Since these operations must be done every 60 samples (or 7.5 ms), this results in a complexity of 88 MIPS. The speed of current signal processing chips is about 10 MIPS, therefore, 88 MIPS is far beyond this capacity. The Federal Standard 1016 employs an overlapped codebook, which reduces the convolution computation by the end-point correction technique, (identical to the technique used in the pitch search calculation). The use of an overlapped codebook reduces the total computation to about 8 MIPS for the remaining speech residual codebook search, and 20 MIPS for the whole algorithm to be done in real time.

Since we know that the speech residual remaining after short and long term prediction is Gaussian distributed, it would seem logical to use a stochastic codebook (generated by a Gaussian processor) in CELP speech coding. However, since stochastic codebooks are generated randomly, there are no special structures to organize them and the only way to search for the optimum vector is an exhaustive search. Although an overlapped codebook reduces the complexity of convolution by end-point correction, as stated above, the computational complexity is still very high (8 MIPS). Furthermore, use of an overlapped codebook for the speech residual is an approximation which degrades quality. The processor of the present application employs a nonoverlapped, deterministic codebook which can be efficiently searched, and therefore reduces the computational complexity necessary for processing the speech residual.

Further reduction of computational complexity results from the computation of the $2^9$ inner products of the speech residual vector with respect to each of the codebook vectors. It is seen that there are only 1's and −1's in the codebook vector so there is actually no need for multiplications. Simply, the appropriate components of the speech residual vector need to be selected then added or subtracted. This allows the $2^9$ inner products to be calculated in very few operations. The calculation of the $2^9$ inner products is described below.

Figures 18, 19:
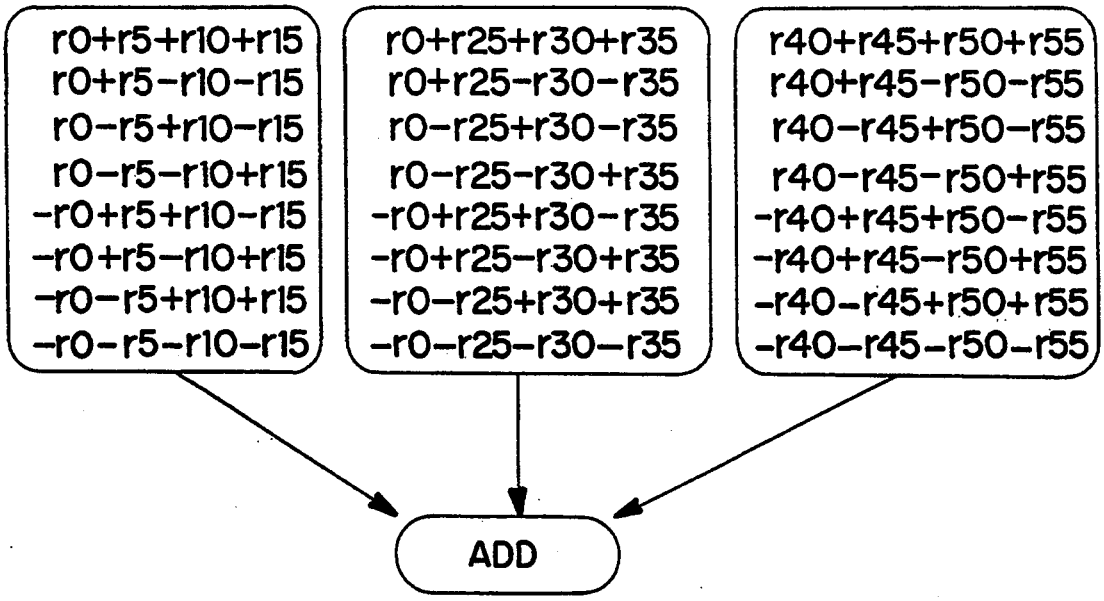
FIG. 18 is a diagram of the possible sign combinations which can be assumed by each subvector of the code book. This facilitates the inner product computation in the CELP coding system of the present invention.
FIG. 19 is a diagram illustrating the combinational method for inner products in the CELP coding system of the present invention.

Beginning with the subvectors of length 20, since only the elements with an index which is a multiple of 5 are non-zero, and they are all +1 or −1, we only need elements with an index which is a multiple of 5 in the speech residual vector in order to calculate all the inner products. For each of the subvectors of each vector, we calculate each sum corresponding to 8 combinations of codebook subvectors (23) as shown in FIG. 18.

For each subvector we have 8 sums. If we pick one of the 8 sums from each of the subvectors and add those three sums we get one inner product. Since there are $8^3$ ways to pick 3 sums from 3 subvectors, that gives us exactly the $2^9$ inner products we need, as shown in FIG. 19. As described above, one sum is selected from each of columns (See FIG. 19) and they are added to get $2^9$ inner products that are necessary.

Subsequently perceptual weighting is performed. A FIR filter is used, which means convolutions of the impulse response H with each of the codebook vectors must be calculated. Since all the codebook vectors have four zeros between two non-zero elements, if the impulse response length is decreased to 5, and only the 5 non-zero coefficients are kept, the codebook vector after perceptual weighting looks like:

$$\frac{(h_0h_1h_2h_3h_4)}{+/-}\,1,\ \frac{(h_0h_1h_2h_3h_4)}{+/-}\,2,\ldots,\ \frac{(h_0h_1h_2h_3h_4)}{+/-}\,12$$

wherein each group of (h0 h1 h2 h3 h4) are of the same sign.

Keeping the same structure as in FIG. 19, we can replace r0 with r0*h0+r1*h1+r2*h2+r3*h3+r4*h4, r5 with r5*h0+r6*h1+r7*h2+r8*h3+r9*h4,

. . .

r55 with r55*h0+r56*h1+r57*h2+r58*h3+r59*h4

Therefore, all $2^9$ products can be obtained with a small number of operations. Finally, the energy of each vector must be calculated after perceptual weighting. The vectors after perceptual weighting are as follows:

$$12^* \sum_{L=0}^{4} h_L^2$$

Their energies are all the same. Because all the codebook vectors are just different combinations of signs, all the components in all the inner products are the same, and it is therefore not necessary to recompute these components, only the signs need be manipulated to get all the inner products. In fact only 1228 operations are necessary to get the 512 inner products, which results in a computational complexity of 0.16 MIPS. Compared with the brute force search requirement of 80 MIPS (512 codebook entries *60 element vector), this represents an improvement of 500 times. Compared with an overlapped codebooks (8 MIPS), this represents an improvement of 50 times. Originally the codebook search dominated the complexity of CELP analysis, but now the computations necessary for the speech residual codebook search are negligible when compared with the computations required for the pitch search.

As long as the non-zero code positions in all codebook vectors are fixed, the absolute values are the same, which means the only difference among all vectors is the different sign combinations, and the above algorithm can be used in order to reduce the computational complexity of a codebook search.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed:

1. A codebook excited linear predictive (CELP) speech processor comprising:

means for supplying a digital speech input representative of human speech;

means for performing linear predictive code analysis and perceptual weight filtering on said digital speech input to obtain short term speech information;

means for performing linear predictive code analysis and perceptual weight filtering on said digital speech input to obtain long term speech information;

a deterministic non-overlapping codebook of a first predetermined number of vectors which are uniformly distributed over a multi-dimensional sphere, each of the first predetermined number of vectors being partitioned into a second predetermined number of sub-vectors, a substantial number of elements of each of the second predetermined number of sub-vectors being defined as zero, and a remaining even number of elements of each of the second predetermined number of sub-vectors defined as +1 or −1, wherein four elements with an index=5N (where N is an integer from 0 to 3) are non-zero for each of the second predetermined number of subvectors and the four non-zero elements of each of the second predetermined number of sub-vectors are all −1, all +1, or two are −1 and two are +1; and means for generating a remaining speech residual of the digital speech input from the deterministic codebook; the short term speech information, the long term speech information and the remaining speech residual being combinable to form a quality reproduction of the digital speech input to reproduce the human speech represented by said digital speech input.

2. The codebook excited linear predictive (CELP) speech processor of claim 1, said means for generating a remaining speech residual including, means for calculating a plurality of inner products for a speech residual vector, representative of the remaining speech residual, with respect to each of the first predetermined number of vectors.

3. The codebook excited linear predictive (CELP) speech processor of claim 2, said means for calculating a plurality of inner products including, means for selecting the remaining even number of elements of each of the second predetermined number of subvectors defined as +1 or −1, means for calculating a plurality of sums for each of the second predetermined number of subvectors, based on the selected remaining even numbers of elements, for each of the first predetermined number of vectors, means for selecting all possible combinations of the plurality of sums for each of the second predetermined number of subvectors, means for summing all possible combinations of the plurality of sums for each of the second predetermined number of subvectors, to obtain the plurality of inner products, means for perceptual weighting each of the first predetermined number of vectors by convolving each of the first predetermined number of vectors with an impulse response, utilizing a FIR filter, and means for detecting an energy level for each of the first predetermined number of vectors.

4. The codebook excited linear predictive (CELP) speech processor of claim 1, wherein said CELP speech processor is used to transmit and receive a digital speech input, representative of human speech, at data rates from 2.4 Kbps to 16 Kbps.

5. The codebook excited linear predictive (CELP) speech processor of claim 4, wherein said CELP speech processor is used to transmit and receive a digital speech input, representative of human speech, at a data rate of 4.8 kbps.

6. The codebook excited linear predictive (CELP) speech processor of claim 1, wherein the multi-dimensional sphere is 60-dimensional.

7. The codebook excited linear predictive (CELP) speech processor of claim 1, wherein the first predetermined number of vectors, uniformly distributed over the 60-dimensional sphere is equal to 512.

8. The codebook excited linear predictive (CELP) speech processor of claim 7, wherein the second predetermined number of subvectors is equal to 1,536, and wherein each subvector contains 20 elements.

9. The codebook excited linear predictive (CELP) speech processor of claim 8, wherein a value of each of the elements of the 1,536 subvectors is −1, 0, or 1.

10. The codebook excited linear predictive (CELP) speech processor of claim 9, wherein 80% of the elements of each of the 1,536 subvectors is equal to zero.

11. The codebook excited linear predictive (CELP) speech processor of claim 10, wherein an even number of elements of each of the 1,536 subvectors are non-zero.

12. A method of encoding speech data including the steps of providing a digital speech input, performing linear predictive code analysis and perceptual weight filtering on the digital speech input to produce a short and long term speech information and generating a deterministic non-overlapping codebook of a first predetermined number of vectors which are uniformly distributed over a multi-dimensional sphere comprising the steps of:

a) partitioning each of the first predetermined number of vectors into a second predetermined number of sub-vectors;

b) setting a substantial number of elements of each of the second predetermined number of sub-vectors to zero;

c) setting a remaining even number of elements of each of the second number of sub-vectors to 1 or −1, wherein four elements with an index of SN (where N is an integer from 0 to 3) are non-zero for each of the second number of sub-vectors and the four non-zero elements of each sub-vector are all −1, all +1, or two are −1 and two are +1; and d) generating a remaining speech residual of the digital speech input from the deterministic codebook such that the short and long term speech information and the remaining speech residual are combinable to form a quality reproduction of the digital speech input.

13. The method of encoding speech data of claim 12, said generating step including, calculating a plurality of inner products for a speech residual vector, representative of the remaining speech residual, with respect to each of the first predetermined number of vectors.

14. The method of encoding speech data of claim 13, said calculating step including, selecting the remaining even number of elements of each of the second predetermined number of sub-vectors defined as +1 or −1, calculating a plurality of sums for each of the second predetermined number of subvectors, based on the selected remaining even number of elements, for each of the first predetermined number of vectors, selecting all possible combinations of the plurality of sums for each of the second predetermined number of subvectors, summing all possible combinations of the plurality of sums for each of the second predetermined number of subvectors, to obtain the plurality of inner products, perceptual weighing each of the first predetermined number of vectors by convolving each of the first predetermined number of vectors with an impulse response, utilizing a FIR filter, and detecting an energy level for each of the first predetermined number of vectors.

15. The method of claim 12, wherein a data rate of the digital speech input and the quality reproduction of the digital speech input is from 2.4 kbps to 16 kpbs.

16. The method of claim 15, wherein a data rate of the digital speech input and the quality reproduction of the digital speech input is 4.8 kbps.

17. The method of claim 12, wherein the multi-dimensional sphere is 60-dimensional.

18. The method of claim 12, wherein the first predetermined number of vectors, uniformly distributed over the 60-dimensional sphere is equal to 512.

19. The method of claim 18, wherein the second predetermined number of subvectors is equal to 1,536, and wherein each subvector contains 20 elements.

20. The method of claim 19, wherein the value of each of the elements of the 1,536 subvectors is −1, 0, or 1.

21. The method of claim 20, wherein 80% of the elements of each of the 1,536 subvectors is equal to zero.

22. The method of claim 21, wherein an even number of elements of each subvector are non-zero.

* * * * *